US005492316A

United States Patent [19]

Moffa et al.

[11] Patent Number: 5,492,316

[45] Date of Patent: Feb. 20, 1996

[54] METHOD AND APPARATUS FOR OPENING SIGNATURE SHEETS

[75] Inventors: Louis P. Moffa; William McFarland, both of Summerville, S.C.

[73] Assignee: Bill McFarland, Summerville, S.C.

[21] Appl. No.: 309,151

[22] Filed: Sep. 20, 1994

[51] Int. Cl.[6] ..... B65H 5/30

[52] U.S. Cl. ..... 270/57

[58] Field of Search ..... 270/55, 57, 54

[56] References Cited

U.S. PATENT DOCUMENTS

| | | | |
|---|---|---|---|
| 1,043,401 | 11/1912 | Cox | 270/55 |
| 2,149,462 | 3/1939 | Oppliger | 270/55 |
| 2,626,074 | 1/1953 | Vogt | 270/55 X |
| 3,561,751 | 2/1971 | Dutro | 270/55 |
| 3,661,379 | 5/1972 | Dolfini | 270/54 |
| 3,669,441 | 6/1972 | Minasian | 270/57 X |
| 3,692,300 | 9/1972 | Mebus . | |
| 3,698,704 | 10/1972 | Hannon et al. | 270/57 |
| 3,722,877 | 3/1973 | Wetter | 270/54 X |
| 4,127,261 | 11/1978 | Meratti | 270/55 |
| 4,275,873 | 6/1981 | Rathert . | |
| 4,401,300 | 8/1983 | Morin | 270/55 |
| 4,403,770 | 9/1983 | Ferguson et al. . | |
| 4,420,146 | 12/1983 | Reist | 270/55 |
| 4,463,941 | 8/1984 | Schlough | 270/54 |
| 4,470,588 | 9/1984 | Geiser . | |
| 4,478,399 | 10/1984 | Morin et al. | 270/55 |
| 4,486,011 | 12/1984 | Rhunke | 270/55 |
| 4,491,311 | 1/1985 | Glanzmann . | |
| 4,522,384 | 6/1985 | Beckley . | |
| 4,526,356 | 7/1985 | Swint | 270/55 |
| 4,704,973 | 11/1987 | Horst . | |
| 4,775,136 | 10/1988 | Petersen . | |
| 4,775,137 | 10/1988 | Glanzmann . | |
| 5,288,067 | 2/1994 | Stock . | |

FOREIGN PATENT DOCUMENTS

| | | | |
|---|---|---|---|
| 0006522A1 | 1/1980 | European Pat. Off. . | |
| 2749095 | 5/1979 | Germany | 270/57 |

*Primary Examiner*—John E. Ryznic
*Attorney, Agent, or Firm*—Hardaway Law Firm

[57] ABSTRACT

A method and apparatus (10) is provided for opening sheets of a signature (7) preparatory to its transport to a thread sewing machine. A plurality of suction plates (30, 32, 34, 36) are spaced from a conveying surface (12), each suction plate having a working surface facing the conveying surface. A plurality of emergent plates (58, 60, 62, 64), corresponding to the suction plates, are provided alongside the conveying surface and are substantially coplanar thereto. The suction plates have respective pivotal mounts (86, 88, 90, 92) proximate their midpoints. At or about the time the signature is positioned in proximity to a suction plate, suction is induced through the suction plate, and an associated emergent plate is actuated to present the signature to the suction plate, bringing a signature sheet into engagement with the working surface of the suction plate. Shortly thereafter, the suction plate pivots about its pivotal mount, whereby a lower end of the suction plate bumps the engaged sheet, causing unopened sheets to move away from the engaged sheet. Such movement, coupled with the restraining of the engaged sheet by suction, produces a hinge effect facilitating opening of the signature sheet.

23 Claims, 9 Drawing Sheets

METHOD AND APPARATUS FOR OPENING SIGNATURE SHEETS

BACKGROUND OF THE INVENTION

This invention relates to an apparatus and method #or opening signature sheets preparatory to transport of the signature to a thread sewing machine.

A signature is comprised o one or more folded sheets, each of which is subdivided into a plurality of signature sheets bounded by fold lines. The fold lines are perforated to facilitate separation of the signature sheets at a later stage in a book manufacturing process.

In opening a signature, the object is to get to the "center," defined herein as the fold line disposed along the spine of the signature dividing it into an equal number of signature sheets, excluding endsheets, on either side of the line. Various systems for accomplishing this purpose are known in the art.

For instance, U.S. Pat. No. 4,275,873 to Rathert discloses a signature feeder wherein signatures are transported in a substantially vertical orientation by a conveyor. A stationary suction block positioned alongside the conveyor opens the outermost page of the signature by applying suction to a lowermost corner thereof, and this process is repeated sequentially with other suction blocks until the "center" is reached.

U.S. Pat. No. 4,463,941 to Schlough discloses an apparatus and methods for opening folded sheets wherein the sheets are transported in a substantially horizontal manner. In the second of the two methods, a vacuum system including a rotary wheel is disposed above a folded sheet being conveyed. The wheel has suction openings enabling the wheel to grip the top page of the folded sheet, thereby opening it. Additionally, a vacuum block is disposed below the bottom page of the folded sheet to grip it, thereby facilitating the opening.

U.S. Pat. No. 4,127,261 to Meratti teaches a device for opening signatures wherein a rotating operative member is provided with supply and take-up reels carrying a roll of pressure-sensitive adhesive tape. The tape passes over a smaller guide roller mounted to the operative member, and the adhesive side of the tape at that location functions as an operative surface engaging the surface of an uppermost signature sheet when a plate positioned alongside the conveying path raises the signature from the conveying surface. Continued rotation of the operative member causes opening of the signature sheet.

U.S. Pat. No. 4,470,588 to Geiser discloses a device for opening folded paper sheets whereby suction devices orbit about axes which are somewhat vertical, being inclined with respect to a vertical axis. Each suction head is located at a terminus of an arm that is 90° to the slanted axis of rotation. Therefore, a suction head moves upwardly during orbital movements of a suction device. This attracts an outermost layer of a folded sheet as it approaches and flexes it outwardly, whereby the inner side of the layer can be intercepted by a stationary retaining element following the respective suction head.

Other machines, while being compact and occupying minimal floor space, have a problem in handling signatures with weak, easily broken, perforations. The handling of such signatures by these machines is such that the machine breaks the perforations, causing misalignment of the signature with respect to a transporting saddle and/or falling of the signature from the saddle. This necessitates that signatures of this type be handfed, significantly reducing production.

While machines such as that disclosed by Rathert employ stationary suction devices to open signatures, the considerable length between the feeding hopper and the sewing station causes occupation of a large amount of floor space and requires frequent back-and-forth trips by the machine operator.

There is a need in the art for a single, compact apparatus which is adaptable to open differing types of signatures. Signatures vary widely in terms of weight, porosity, thickness, and number of sheets and in terms of the strength of the perforations along the folding lines. Such varied signatures, which occur primarily in the United States, cannot be consistently opened by conventional signature feeder machines predominantly constructed by European manufacturers. Moreover, 4-page signatures have been known to become airborne due to their light weight.

SUMMARY OF THE INVENTION

It is an important object of the present invention to provide a method and apparatus for consistently opening a wide variety of signatures to their centers without the need for manual feeding of signatures into a bookbinding machine.

It is a further object of the present invention to provide an apparatus for opening signatures which can open various signatures at a uniform air pressure, common to all signature types.

It is a further object of the present invention to provide an apparatus for opening signatures which retains the advantages of compactness inherent in some prior art feeders but which provides improved handling and opening of signatures.

It is a further object of the present invention to provide a method and apparatus which employs a hinge effect, whereby pivoting action of a suction plate, which may be assisted by gravity, facilitates opening of a signature to its center.

These as well as other objects are accomplished by a method for opening a sheet of a signature moving along a conveying surface, comprising the steps of providing a suction plate spaced from the conveying surface, the suction plate having a working surface facing the conveying surface, advancing the signature to a position in proximity to the suction plate, inducing a vacuum through the suction plate such that the sheet is engaged by the working surface, and inclining the suction plate from an idle position to an actuated position. The engaged sheet is thereby brought to an open position with respect to remaining sheets of the signature.

The foregoing objects are also accomplished by an apparatus for sequentially opening a plurality of sheets forming a signature, comprising a conveying surface, at least one pivotally mounted suction plate being spaced from the conveying surface and having a working surface facing the conveying surface, and an advancing mechanism moving the signature along the conveying surface and advancing the signature to a position in proximity to the suction plate.

BRIEF DESCRIPTION OF THE DRAWINGS

FIG. 6-A is a bottom view of a suction plate used in the apparatus illustrated in FIG. 6.

DETAILED DESCRIPTION

In order to achieve a suitable understanding of the context of the operation of the invention, t is first necessary to particularly describe what a signature is.

Figure 1:
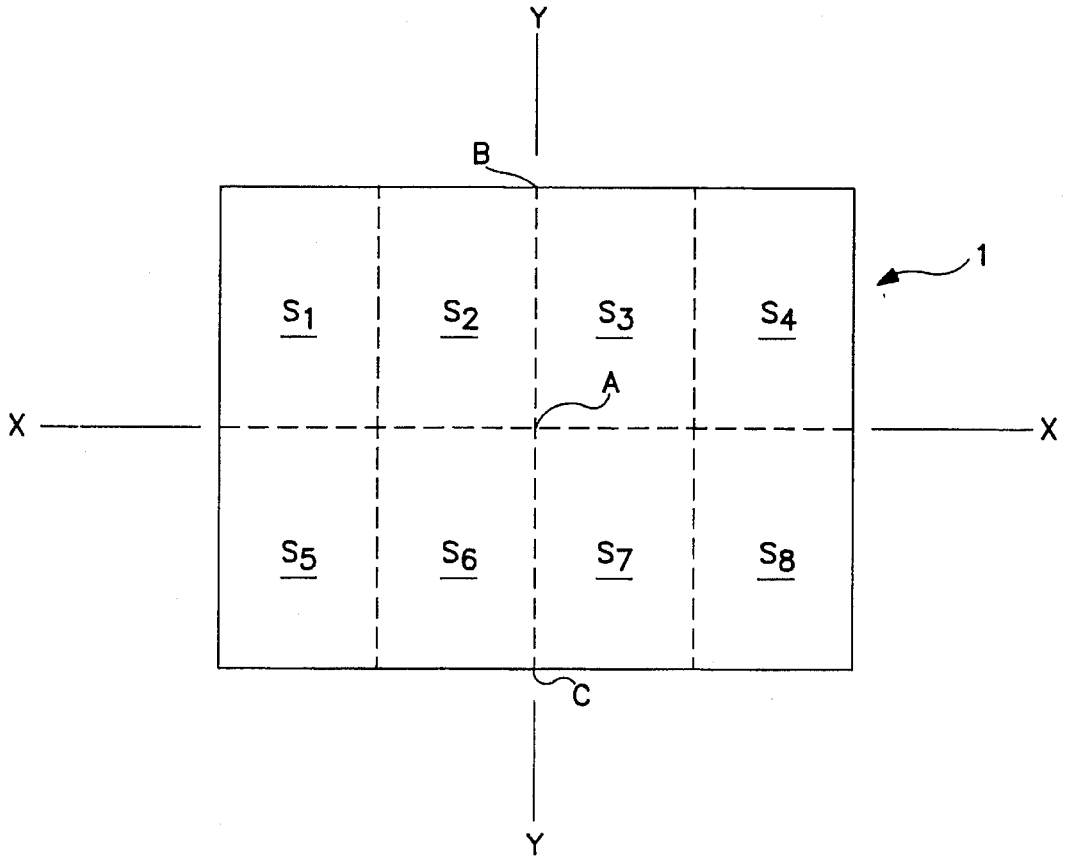
FIG. 1 is a plan view of an original sheet subdivided into signature sheets along fold lines.

Referring to FIG. 1, an original sheet 1 is subdivided into a plurality of signature sheets, here $S_1$–$S_8$, along fold lines indicated by the broken lines on the sheet. Lines X—X and Y—Y define the central axes of sheet 1, and point A is the point of intersection of these axes. Points B and C are the points of intersection of line Y—Y with the upper and lower edges of sheet 1, respectively.

Figure 2:
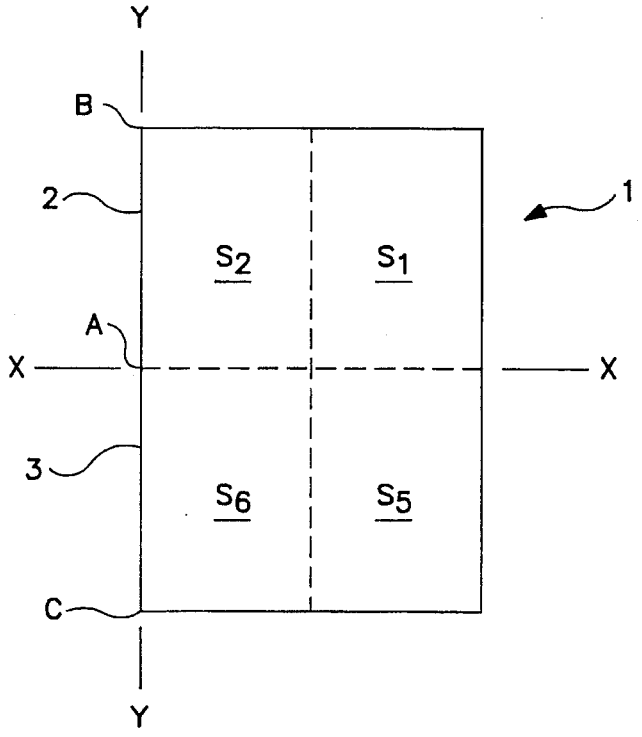
FIG. 2 is a plan view of the sheet illustrated in FIG. 1 after having been once folded.

In FIG. 2, sheet 1 has been folded about line Y—Y such that signature sheets $S_2$ and $S_1$ are superposed upon signature sheets $S_3$ and $S_4$, respectively, and such that signature sheets $S_6$ and $S_5$ are superposed upon signature sheets $S_7$ and $S_8$, respectively. Folded edge 2, running from point A to point B, and folded edge 3, running from point A to point C, are colinear with line Y—Y.

In FIG. 3, sheet 1 has been again folded, this time about line X—X, such that signature sheet $S_3$ is superposed upon signature sheets $S_2$, $S_6$ and $S_7$, and such that signature sheets $S_4$ is superposed upon signature sheets $S_1$, $S_5$, and $S_8$. Line Y'—Y' contains the fold line dividing signature sheets $S_3$ and $S_4$, and point D is the point at which line Y'—Y' intersects the now-folded edge along line X—X. Point E is the upper right-hand corner of signature sheet $S_4$. Folded edge 4, running from point D to point A, and folded edge 5, running from point D to point E, are colinear along line X—X.

Figure 3:
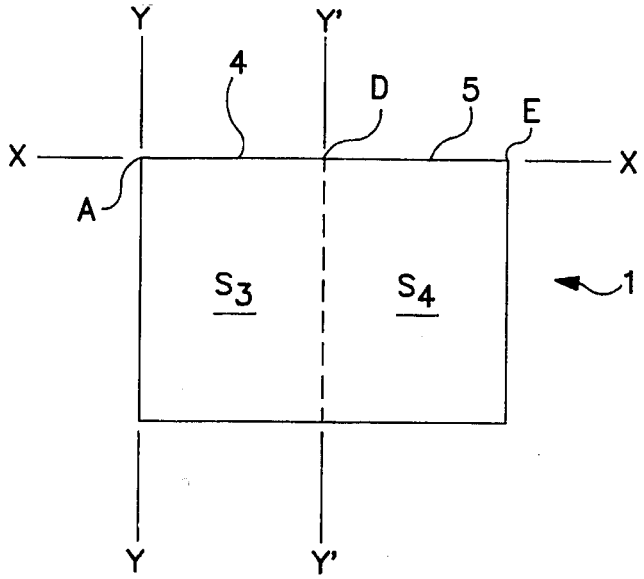
FIG. 3 is a plan view of the sheet illustrated in FIG. 1 after having been twice folded.
Figure 4:
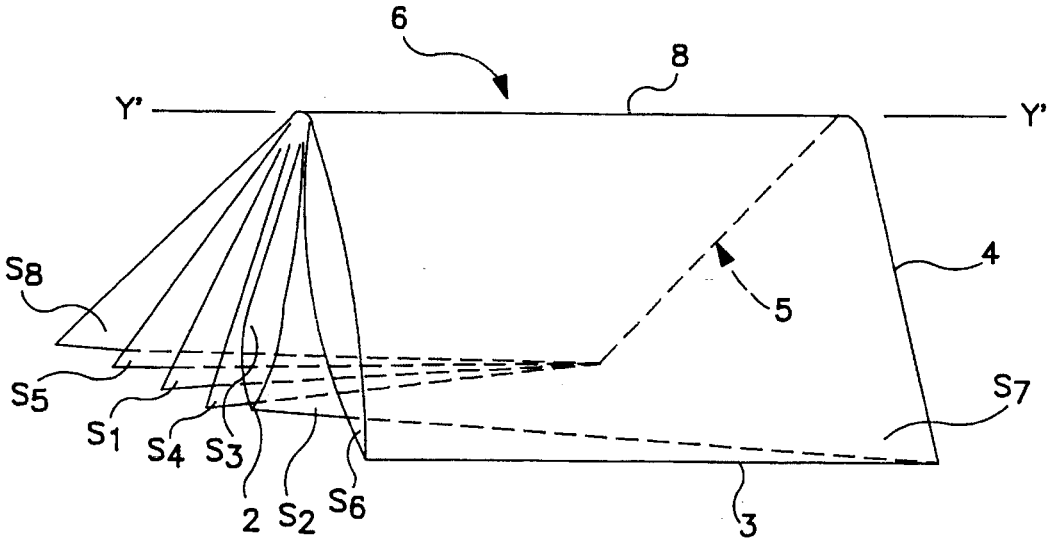
FIG. 4 is a perspective view of a sixteen-page signature.

In FIG. 4, the sheet 1 of FIG. 3 has been folded along Y'—Y' to form a sixteen-page signature 6 (two sides per signature sheet). The signature 6 includes a spine 8 colinear with line Y'—Y'. In this arrangement, it is seen that folded edge 4 is common to sheets $S_7$, $S_6$, $S_2$, and $S_3$, and that folded edge 5 is common to the remaining sheets of the signature. As used herein, the term "open", or any variation thereof, as applied to a signature, means to move signature sheets from the position shown in FIG. 4, or from a more closed position, toward an unfolded position such as that shown in FIG. 3. Only a single act of opening is necessary to get to the center of sixteen-page signature 6, since lifting folded edge 4 causes lifting of four signature sheets.

Figure 5:
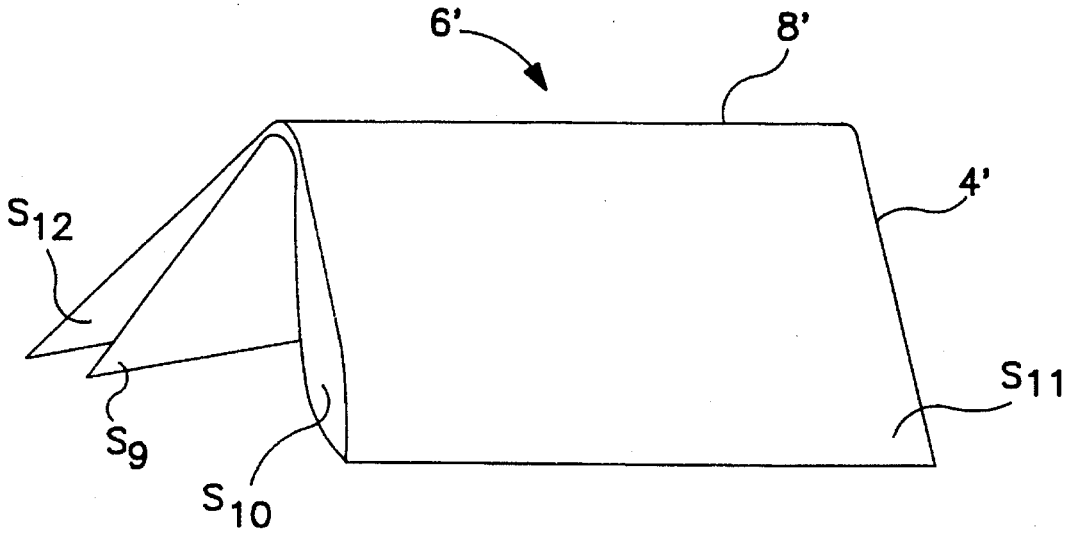
FIG. 5 is a perspective view of an eight-page signature.

FIG. 5 illustrates an eight-page signature 6' comprised of four signature sheets $S_9$, $S_{10}$, $S_{11}$, and $S_{12}$. Since signature sheets $S_{10}$ and $S_{11}$ share a common folded edge 4', only a single act of opening is required to get to the center of signature 6'.

FIGS. 6–13 illustrate an apparatus and method for opening a signature preparatory to its transport to a thread sewing machine. In the following description, "signature 7" refers to a composite signature comprising signature 6' (FIG. 5) inserted into signature 6 (FIG. 4) such that spine 8' of signature 6' is fully inserted between signature sheets $S_3$ and $S_4$ of signature 6. Spine 8 of signature 6 thus likewise serves as the spine of composite signature 7. Furthermore, since composite signature 7 includes two signatures, each requiring one opening to get to their respective centers, composite signature 7 requires two openings to get to its center.

Figure 6:
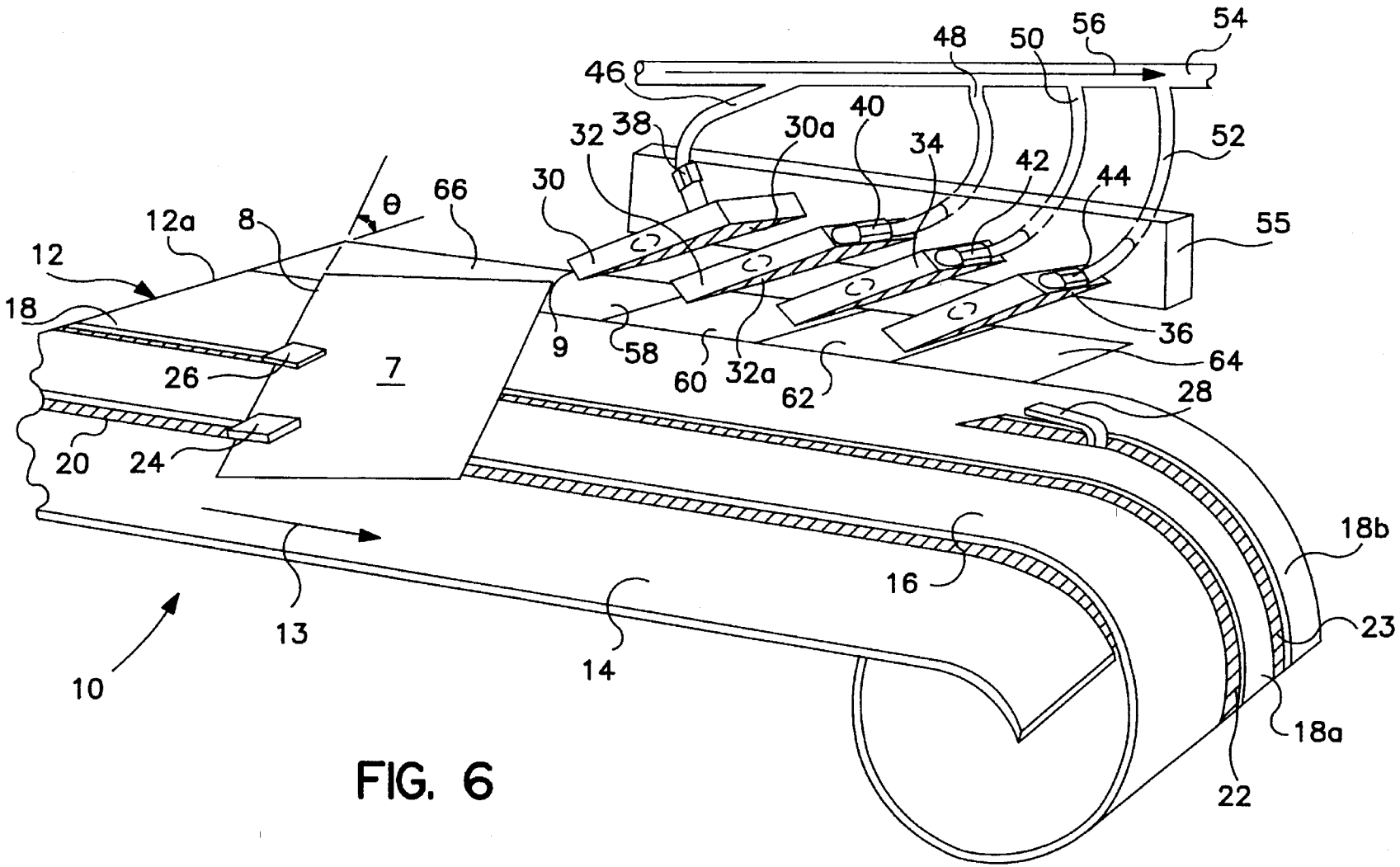
FIG. 6 is a perspective view of a signature opening apparatus constructed in accordance with the preferred embodiment of the present invention.
Figure 6A:
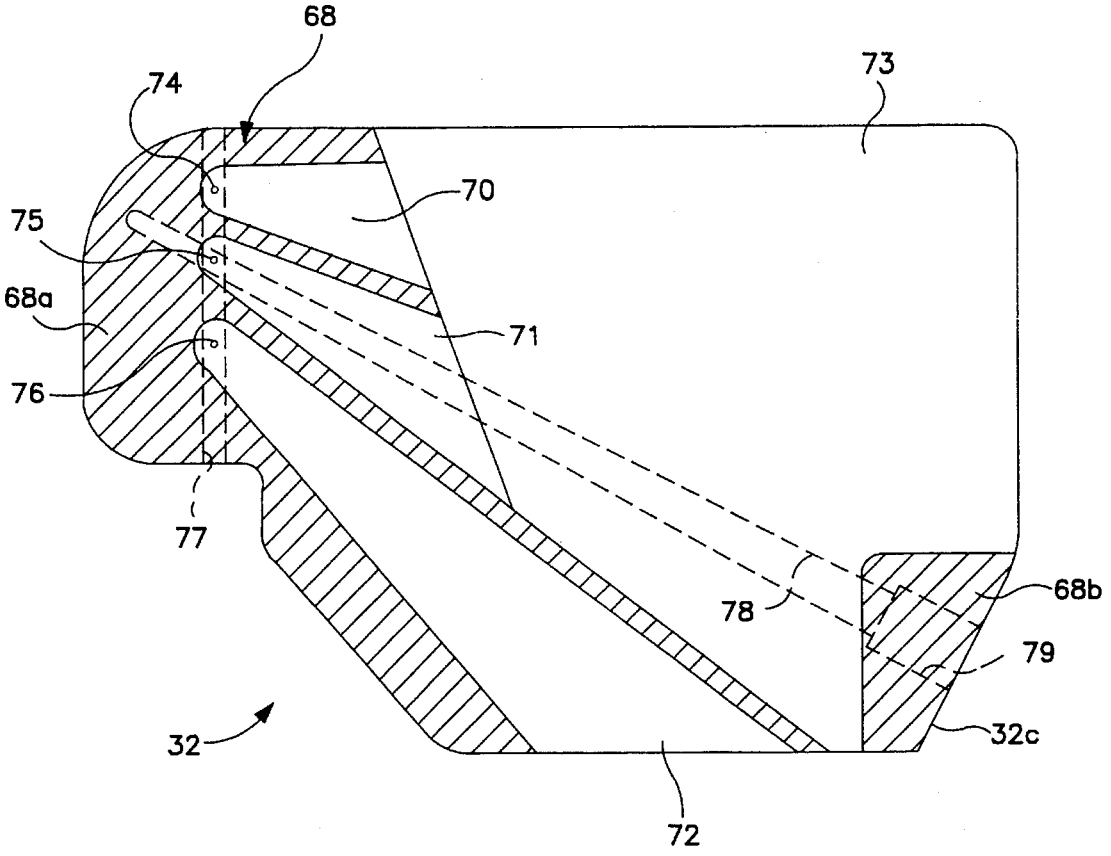

In FIG. 6, signature 7 is shown as being handled by an apparatus 10 for performing successive openings of a signature until its center is reached. Signature 7 is advanced in the downstream direction, shown by arrow 13, along a substantially horizontal conveying surface 12, comprised of a plurality of coplanar surfaces 14, 16, and 18 interrupted by parallel gaps 20, 22. Similarly, a gap 23 is formed into a downstream portion of surface 18, dividing it into prongs 18*a* and 18*b*. Gaps 20, 22 allow chain grippers 24, 26, protruding above conveying surface 12, to engage the signature 7 at its spine 8 and advance it along that surface. A spring assembly 28 protrudes above conveying surface 12 to receive the signature 7 after it has undergone the opening process, to be described in detail herein. At such a time the spring assembly 28 moves the signature 7 off of the conveying surface 12 and onto a transporting saddle (not shown) for eventual sewing. The particular means for moving spring assembly 28, as well as for actuating chain grippers 24, 26 in synchronism with deposits of signatures from a loading hopper (not shown) to the conveying surface 12, are known.

A plurality of suction plates 30, 32, 34, 36 are disposed above conveying surface 12 such that their working surfaces, such as at 30*a* and 32*a*, are facing conveying surface 12. The term "facing" as used herein means that a longitudinal axis such as at 31 (see FIG. 7) of a suction plate makes no more than a 45° angle with the plane of the conveying surface 12 in its idle, unactuated position, although the preferred range is from 0°–30° in the idle position. As will be explained in detail herein, each suction plate is preferably mounted to an associated rotatable shaft for pivotal movement. Suction plates 30, 32, 34, 36 are provided with corresponding fittings 38, 40, 42, 44 and tubes 46, 48, 50, 52 to provide a common connection to a conduit 54, through which a uniform air flow 56 moves. Preferably, tubes 48, 50, 52 pass through a plate 55 to aid in their positioning with respect to feeder machine components constituting the environment of apparatus 10. Since each suction plate has a bore therethrough (see FIG. 6-A) communicating with its associated fitting, air flow 56 enables suction plates 30, 32, 34, 36, to impart a venturi-type vacuum action to articles passing in proximity to their respective working surfaces.

Also shown in FIG. 6 are a plurality of emergent plates 58, 60, 62, 64, which are respectively beneath suction plates 30, 32, 34, 36, which are positioned alongside conveying surface 12, and which are substantially coplanar to conveying surface 12 when in the positions shown. Apparatus 10 may also include an auxiliary surface 66 contiguous with an upstream edge of emergent plate 58 and also coplanar with conveying surface 12. Emergent plates 58, 60, 62, 64 present signature 7 to associated suction plates, in a manner to be explained in detail with regard to FIGS. 7–12. These emergent plates are designed to emerge above the elevation of the conveying surface 12 and then to be retracted to resume the position shown in FIG. 6. The emergent plate actuating mechanism for accomplishing this movement at controlled and synchronized intervals comprises a timing cam, a micro switch, and a pneumatic actuator disposed beneath conveying surface 12 (mechanism not shown).

While being advanced along the conveying surface 12, the signature 7 is preferably horizontal (spine 8 parallel to plane of conveying surface 12) and preferably remains at an angle to its line of travel 13, as best seen by the angle θ that its spine 8 makes with the rear 12*a* of conveying surface 12. This positioning is advantageous by ensuring that spine 8 does not engage any of the suction plates as the signature 7 is advanced, thus preventing any hanging up of an opened signature sheet on inert (upper) surfaces of downstream suction plates.

FIG. 6-A illustrates the bottom of a representative suction plate, such as 32, used in the apparatus and method of the present invention. The working surface 68 of suction plate 32 is defined by the shaded coplanar regions shown at 68*a* and 68*b*. Recessed into the working surface 68 are three intermediate surfaces 70, 71, 72, and a sheet clearance surface 73 recessed at a greater depth than the intermediate surfaces. Air holes 74, 75, 76 are drilled into intermediate surfaces 70, 71, 72, respectively, and they are interconnected by a transverse bore 77. Each air hole is drilled at a small angle with respect to its associated intermediate surface so as to induce air flow across it rather than directly against the signature sheet to be opened. An inlet bore 78 extends through suction plate 32 from a corner 32*c* to communicate with transverse bore 77. The originating end of inlet bore 78 is enlarged as shown at 79 to accommodate fitting 40 (FIG. 6). Thus, air enters inlet bore 78, exits air holes 74, 75, 76, and flows across intermediate surfaces 70, 71, 72 to create the venturi vacuum effected upon a signature sheet. This type of sheet engagement is seen as an improvement over prior art devices in that, unlike the tearing of perforations caused by force applied to the outermost signature sheet and concentrated on points thereof, the suction force is applied evenly across the engaged portion of the signature sheet.

The particular sequential steps of opening a signature according to the method of the present invention will now be described with reference to FIGS. 7–12. In each of these figures, joined sheets such as sheets $S_7$, $S_6$, $S_2$, and $S_3$ (FIG. 4) are collectively represented by a single sheet for ease in illustration. The term "sheet" as used hereafter and in the claims will be understood to include such joined sheets, as well as a single sheet, or end sheet. Also, although reference in these figures to only chain gripper 24 is made in describing the motion it imparts to the signature 7, it is understood that chain gripper 26 (FIG. 6) likewise imparts such motion.

Figure 7:
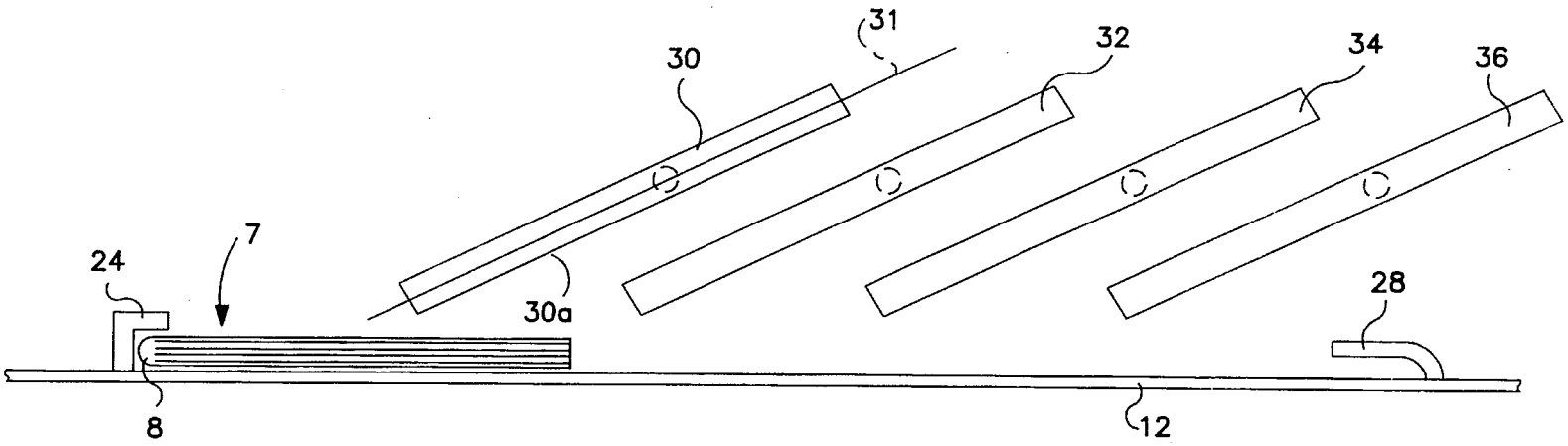
FIGS. 7–12 are front elevation views of the apparatus illustrated in FIG. 1, isolating a signature, suction plates, and a conveying surface with associated elements, each view illustrating a sequential step in the opening of the signature to its center.

Referring to FIG. 7, signature 7 is advanced to a position in proximity to suction plate 30, meaning that corner 9 (FIG. 6) is positioned beneath suction plate 30. Corner 9 is thereby also aligned with (positioned over) emergent plate 58 (FIG. 6). Signature 7 is brought to the position shown by chain gripper 24 engaging spine 8 and moving in the downstream direction. The moment corner 9 reaches this position, air begins to flow through conduit 54 (FIG. 6) to cause suction by venturi action to be induced through suction plate 30.

Figure 8:
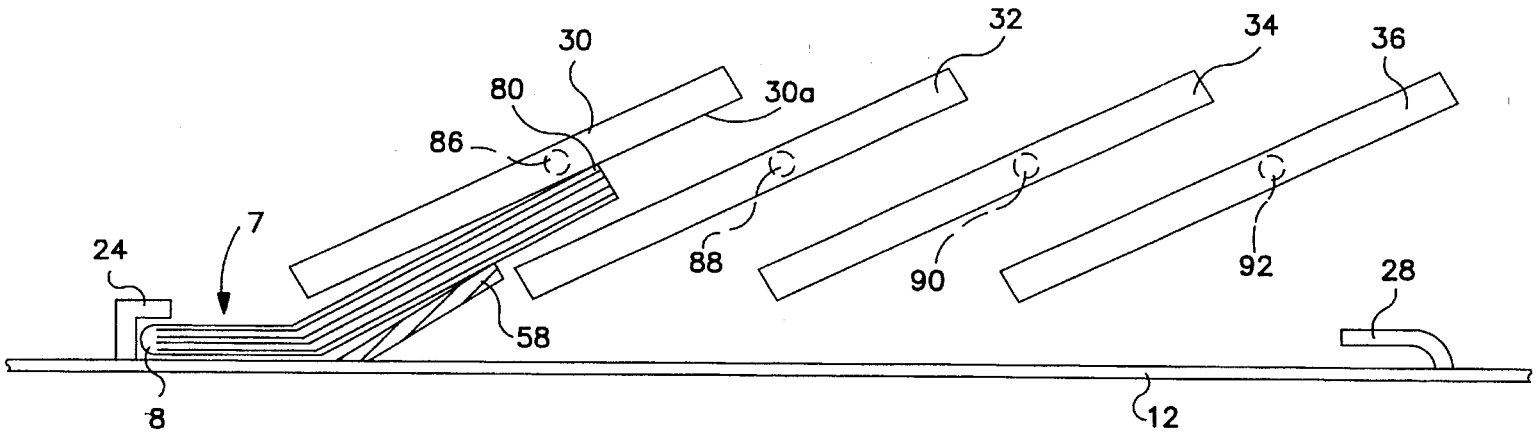

Simultaneously, or immediately after the event depicted above, the signature 7 undergoes the step depicted in FIG. 8. Emergent plate 58 is actuated to move signature 7, in a direction substantially normal to its path of travel, presenting it to suction plate 30, whereby signature 7 is moved toward working surface 30*a*, and outermost sheet 80 is engaged by that surface, meaning that it is restrained by suction against other movement. Although outermost sheet 80 is shown contacting working surface 30*a*, such contact need not take place under the foregoing definition of "engaged".

Figure 9:
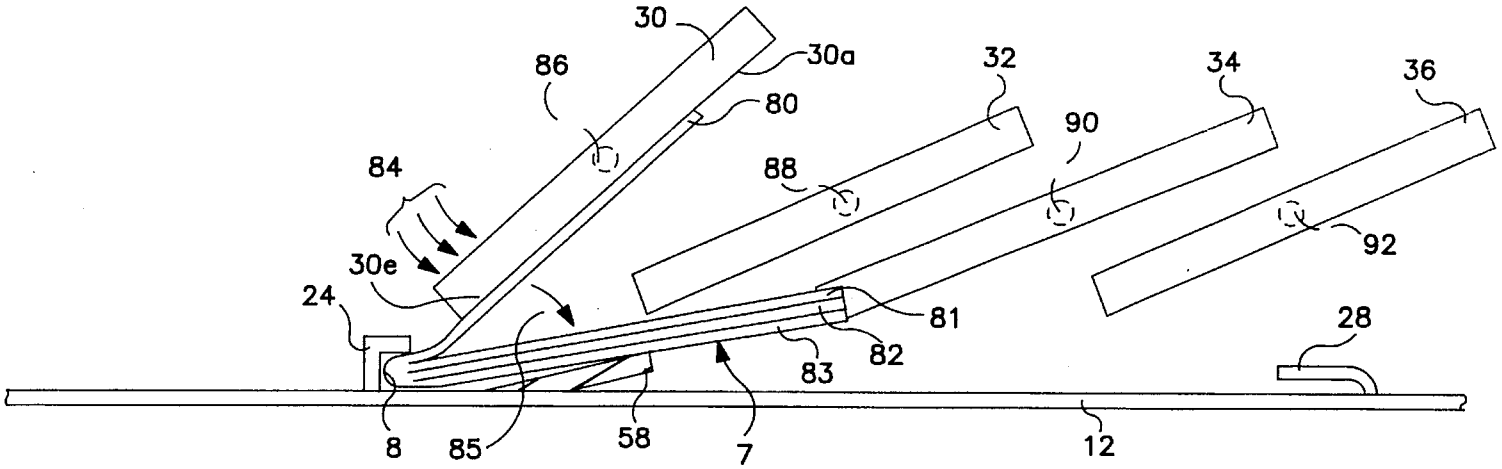

In FIG. 9, suction plates 30, 32, 34, 36 are shown as being provided with respective pivotal mounts 86, 88, 90, 92 proximate their midpoints. Here, suction plate 30 has pivoted about mount 86 in a counterclockwise direction, whereby lower end 30*e* of suction plate 30 moves in the direction shown by arrows 84 to bump outermost sheet 80, causing unopened sheets 81, 82, 83 to move away from sheet 80, as shown by direction arrow 85. Thus, suction plate 30 is inclined from its idle position (FIGS. 7 & 8) to an actuated position (FIG. 9), meaning that in the actuated position, axis 31 (FIG. 7) of suction plate 30 makes a greater angle with the plane of conveying surface 12 than when suction plate 30 is in its idle position. It is to be understood that while employing a pivoting action is the preferred method of accomplishing suction plate inclination, any means imparting such inclination is contemplated as being within the scope of the present invention.

The movement imparted to the unopened signature sheets by lower end 30*e* of suction plate 30, coupled with the engagement of outermost sheet 80, produces what is termed herein as a "hinge effect", whereby a signature sheet is brought to an opened position with respect to the unopened sheets of the signature. The "hinge effect" allows a greater variety of signatures to be opened with a single, uniform venturi air pressure than can be achieved with prior art devices. Simultaneously with the pivoting of suction plate 30, emergent plate 58 retracts toward its idle position (FIG. 6). If conveying surface 12 is oriented substantially horizontally as shown, such retraction enables gravity to assist in the movement of the unopened sheets 81, 82, 83 in the direction of arrow 85 toward conveying surface 12, thereby enhancing the hinge effect.

Figure 10:
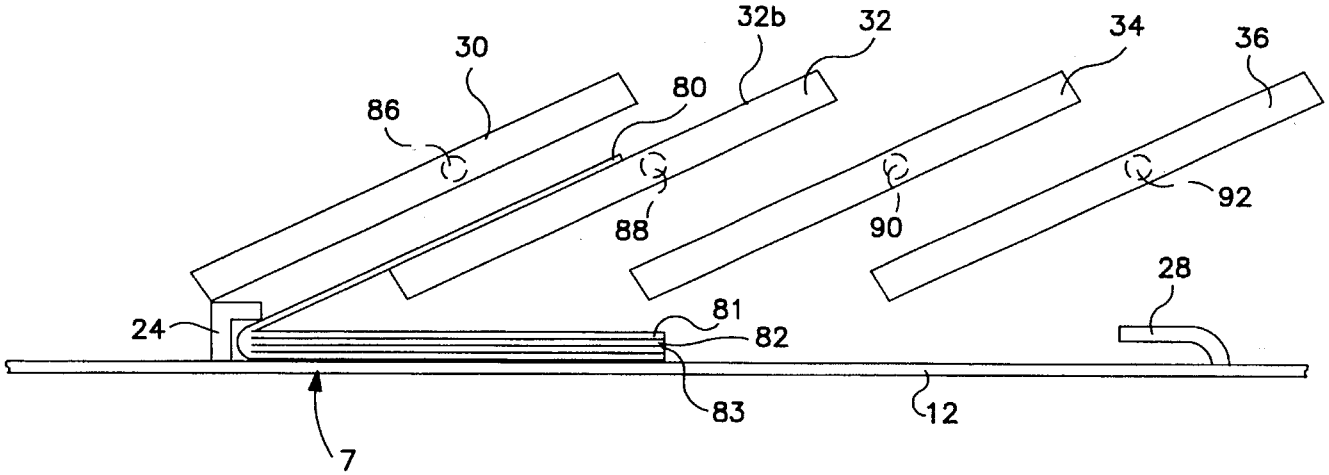

Referring to FIG. 10, chain gripper 24 continues to impart downstream movement to the signature 7, which has been advanced from the position described in FIG. 9 to a position in proximity to suction plate 32 and in alignment with emergent plate 60 (FIG. 6). At this position, several changes have occurred from the event depicted in FIG. 9. First, suction force applied through suction plate 30 has been deactivated, causing outermost sheet 80 to fall by gravity onto inert surface 32*b* of suction plate 32, which supports that sheet to maintain it in the opened position. Second, suction plate 30 has been rotated clockwise, whereby it has been returned it to its idle position, i.e., its longitudinal axis 31 (FIG. 7) is substantially parallel to corresponding axes of the other suction plates. Third, emergent plate 58 has retracted completely to its initial, idle position such that it is no longer visible from the perspective of FIG. 10.

Figure 11:
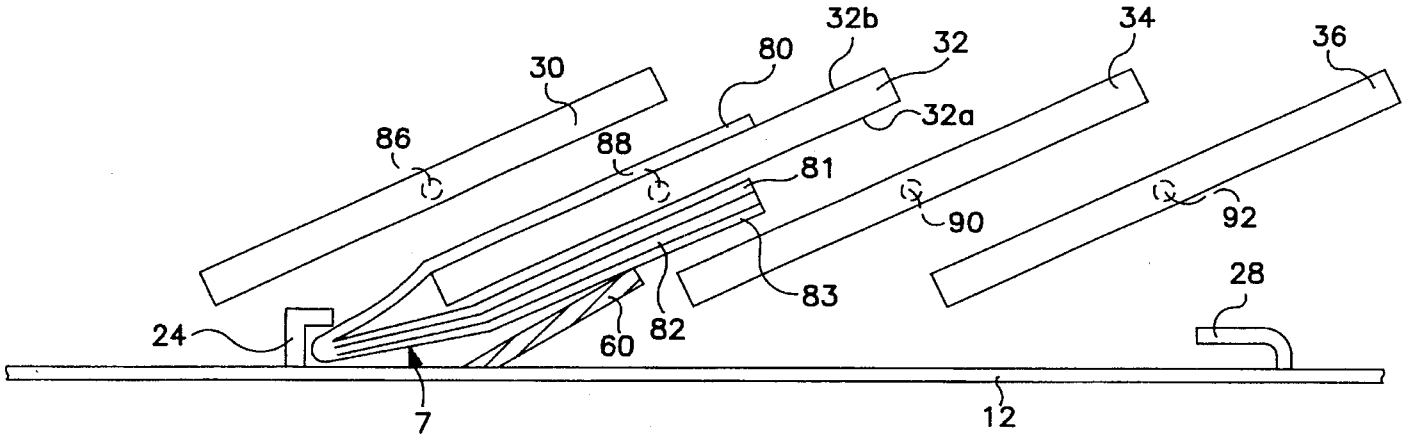

In FIG. 11, signature 7 has been advanced further by chain gripper 24, such that a part of outermost sheet 80 has slid further up inert surface 32*b* of suction plate 32. At this point, suction force through suction plate 32 has been induced. Emergent plate 60 is now actuated to move unopened sheets 81, 82, 83 in a direction substantially normal to the path of travel of signature 7, thereby moving that portion of signature 7 toward working surface 32*a* of suction plate 32 and causing that surface to engage next outermost sheet.81.

Figure 12:
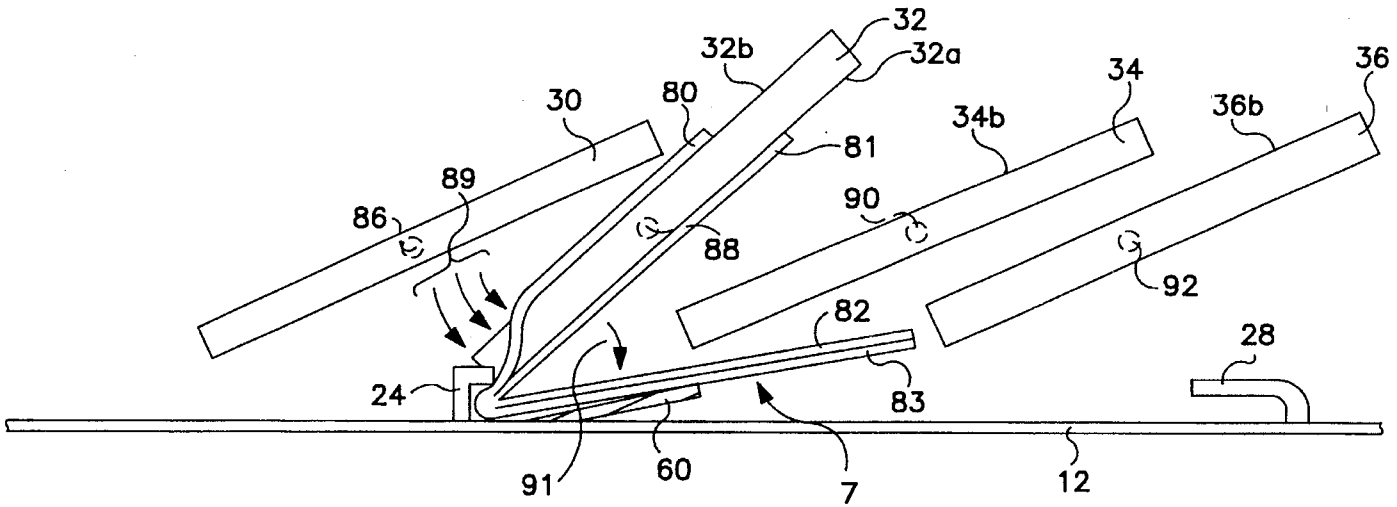

Referring to FIG. 12, advancement of the signature 7 continues, wherein outermost sheet 80 begins to be pulled off of inert surface 32*b* of suction plate 32. Next outermost sheet 81 continues to be engaged by working surface 32*a* of suction plate 32, which is shown pivoting counterclockwise about pivot mount 88. End 32*e* of suction plate 32 therefore moves in the direction of arrows 89 to bump next outermost sheet 81, causing unopened sheets 82 and 83 to move away from sheet 81 in the direction shown by arrow 91. The hinge effect therefore again occurs, this time with respect to next outermost sheet 81. Simultaneously, emergent plate 60 is shown to be retracting into its idle position, thus causing gravity to enhance the hinge effect in the manner previously described with regard to FIG. 9.

Because only two openings are needed to reach the center of signature 7, its center is reached upon the opening of next outermost sheet 81. Upon deactivation of suction through suction plate 32, both the outermost and next outermost sheets 80 and 81, respectively, rest in superposed relation upon inert surface 34*b* (FIG. 12) of suction plate 34. Further advancement of signature 7 by chain gripper 24 causes these sheets to momentarily rest in like manner upon inert surface 36*b* of suction plate 36. The apparatus 10 is programmed so that suction is not applied to suction plates 34 and 36 and so that emergent plates 62, 64 (FIG. 6) are not actuated; thus, sheets 82 and 83 remain unopened. It is understood, however, that sequential application of suction through suction plates 34, 36, as well as sequential actuation of emergent plates 62, 64, would occur if signature 7 required four openings, such as if an endsheet divided into two folded sheets were glued to the spine 8 of signature 7.

When sheets 80, 81 begin descending from inert surface 36b, the unopened sheets 82, 83 become held by the spring assembly 28. Once this descent is completed, spring assembly 28 becomes interposed between sheets 81 and 83. Thus, the sheets which have been opened rest atop the spring assembly 28, while the unopened sheets are held by it, thereby keeping the signature 7 open at its center. Spring assembly 28 moves downstream, transferring signature 7 off conveying surface 12 and onto a transporting saddle (not shown), where the signature continues to be held open at its center during transport.

Although a two-opening signature has been shown in the foregoing figures, it is understood that apparatus 10 can open signatures requiring a greater number of openings. It is also understood that apparatus 10 need not be provided with four suction plates; a greater or lesser number of plates may be used, depending on signature characteristics or customer specifications. Nor need the conveying surface 12, its associated elements, and the emergent plates be oriented substantially horizontally.

Figure 13:
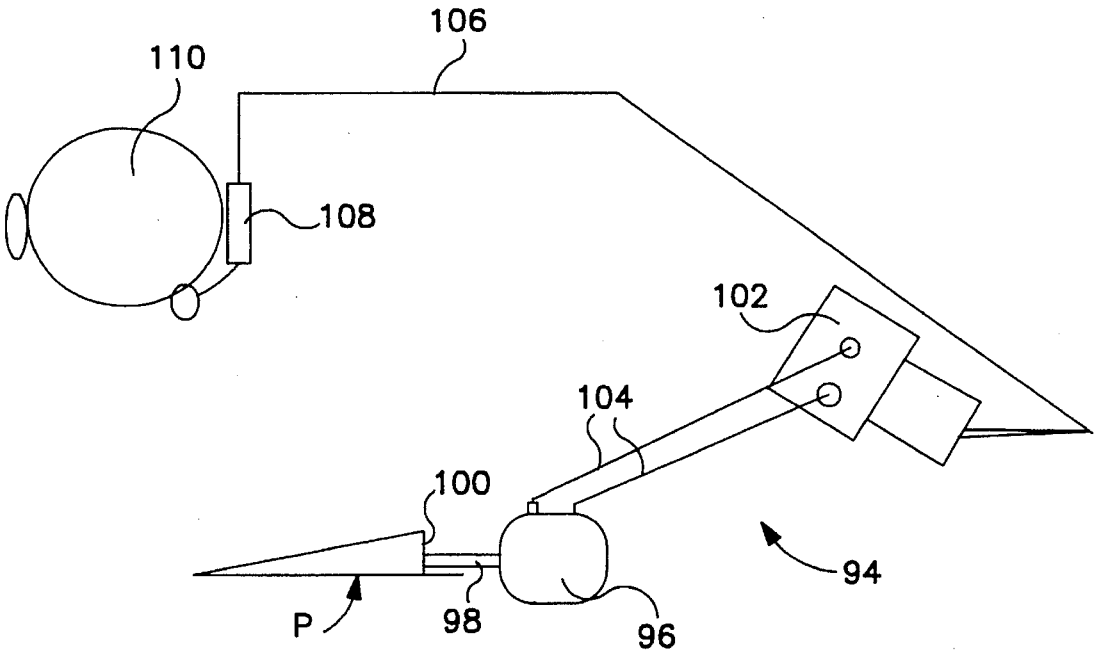
FIG. 13 is a schematic view of a suction plate actuating system constructed in accordance with a preferred embodiment of the present invention.

Referring to FIG. 13, a suction plate actuating mechanism 94 is schematically shown, representative of mechanisms provided for each suction plate 30, 32, 34, 36 (FIGS. 6–12). Mechanism 94 pivots suction plate P in a counterclockwise direction (see FIGS. 9 at 30 & 12 at 32) when suction is applied through suction plate P. A rotary member 96 carries a shaft 98 engaging a rear side 100 of suction plate P. A pneumatic actuator 102 communicates with the rotary member 96 via air conduits 104. Electronically communicating with the pneumatic actuator 102 via a lead 106 is a micro switch 108. A driven timing cam 110 periodically closes the micro switch 108. Thus, the pneumatic actuator 102 periodically releases air through air conduits 104 to actuate suction plate P through the rotary member 96 responsive to the closing of the micro switch 108 by driven timing cam 110.

It is thus seen that a method and apparatus may be provided whereby different types of signatures may be effectively opened at a uniform air pressure and without requiring manual feeding of signatures.

As the foregoing description is merely exemplary in nature, being merely illustrative of the invention, many variations will become apparent to those of skill in the art. Such variations, however, are included within the spirit and scope of this invention as defined by the following appended claims.

That which is claimed:

1. An apparatus for sequentially opening a plurality of sheets forming a signature, comprising:

a conveying surface;

at least one suction plate, said suction plate being spaced from said conveying surface and having a working surface facing said conveying surface; and an advancing mechanism moving said signature along said conveying surface and advancing said signature to a position in proximity to said suction plate.

2. An apparatus for sequentially opening a plurality of sheets forming a signature, comprising:

a substantially horizontal conveying surface;

at least one suction plate, said suction plate being disposed above said conveying surface and having a working surface facing said conveying surface; and an advancing mechanism moving said signature along said conveying surface and advancing said signature to a position in proximity to said suction plate.

3. The apparatus set forth in claim 2 wherein each suction plate includes:

a working surface;

an intermediate surface recessed into said working surface;

an air hole drilled into said intermediate surface; and an inlet bore communicating with said air hole.

4. The apparatus set forth in claim 3 wherein said suction plate further includes a sheet clearance surface recessed into said working surface at a greater depth than said intermediate surface.

5. An apparatus for sequentially opening a plurality of sheets forming a signature, comprising:

a conveying surface;

at least one pivotally mounted suction plate, said suction plate being spaced from said conveying surface and having a working surface facing said conveying surface; and an advancing mechanism moving said signature along said conveying surface and advancing said signature to a position in proximity to said suction plate.

6. A method for opening a sheet of a signature moving along a conveying surface, comprising the steps of:

providing a suction plate spaced from said conveying surface, said suction plate having a working surface facing said conveying surface;

advancing said signature to a position in proximity to said suction plate;

moving said signature in a direction substantially normal to its path of travel toward said working surface; and inducing a vacuum through said suction plate such that said sheet is engaged by said working surface;

whereby said sheet is brought to an open position with respect to remaining sheets of said signature.

7. The method set forth in claim 6 comprising the further step of pivoting said suction plate, whereby a hinge effect is created to facilitate opening of said sheet.

8. The method set forth in claim 6 wherein said step of moving said signature toward said working surface includes the steps of:

providing an emergent plate substantially coplanar to said conveying surface;

aligning said signature with said emergent plate; and actuating said emergent plate.

9. The method set forth in claim 8 wherein said emergent plate is actuated during said step of advancing said signature to a position in proximity to said suction plate.

10. The method set forth in claim 8 comprising the further step of retracting said emergent plate during said step of inducing a vacuum through said suction plate.

11. The method set forth in claim 10 wherein said suction plate and said conveying surface are substantially horizontal, whereby gravity acts on said remaining sheets of said signature to assist in opening said signature.

12. A method for sequentially opening outermost and next outermost sheets of a signature moving along a conveying surface, comprising the steps of:

providing first and second suction plates, each of said suction plates being spaced from said conveying surface and having inert and working surfaces, each of said working surfaces facing said conveying surface;

advancing said signature along said conveying surface to a position in proximity to said first suction plate;

moving said signature in a direction substantially normal to its path of travel toward said working surface of said first suction plate; and inducing a vacuum through said first suction plate such that said outermost sheet is engaged by said working surface of said first suction plate to bring said outermost sheet to an opened position;

advancing said signature along said conveying surface to a position in proximity to a second suction plate;

causing said inert surface of said second suction plate to maintain said outermost sheet in said opened position;

moving said signature in a direction substantially normal to its path of travel toward said working surface of said second suction plate; and inducing a vacuum through said second suction plate such that said next outermost sheet is engaged by said working surface of said second suction plate to bring said next outermost sheet to an opened position.

13. The method set forth in claim 12 wherein said signature is advanced at an angle to a line of travel of said signature along said conveying surface.

14. The method set forth in claim 12 wherein said steps of respectively moving said outermost and next outermost sheets toward said working surfaces of said first and second suction plates include the steps of:

providing first and second emergent plates substantially coplanar to said conveying surface, said emergent plates corresponding to said first and second suction plates;

sequentially aligning said signature with each emergent plate; and sequentially actuating each emergent plate.

15. The method set forth in claim 14 comprising the further step of sequentially pivoting said first and second suction plates, whereby a hinge effect is created to facilitate opening of said outermost and next outermost sheets.

16. The method set forth in claim 14 comprising the further step of sequentially retracting each actuated emergent plate while suction is applied through a corresponding suction plate.

17. The method set forth in claim 16 wherein said first and second suction plate and said conveying surface are substantially horizontal, whereby gravity acts on unopened sheets of said signature to assist in opening said signature.

18. A method for opening a sheet of a signature moving along a conveying surface, comprising the steps of:

providing a suction plate spaced from said conveying surface, said suction plate having a working surface facing said conveying surface;

advancing said signature to a position in proximity to said suction plate;

inducing a vacuum through said suction plate such that said sheet is engaged by said working surface; and inclining said suction plate from an idle position to an actuated position;

whereby said sheet is brought to an open position with respect to remaining sheets of said signature.

19. The method set forth in claim 18 comprising the further step of moving said signature in a direction substantially normal to its path of travel toward said working surface.

20. An apparatus for sequentially opening a plurality of sheets forming a signature, comprising:

a substantially horizontal conveying surface;

at least one suction plate, said suction plate being disposed above said conveying surface and having a working surface facing said conveying surface;

an emergent plate per each suction plate, said emergent plate being substantially coplanar to said substantially horizontal conveying surface; and an advancing mechanism moving said signature along said conveying surface and advancing said signature to a position in proximity to said suction plate.

21. The apparatus set forth in claim 20 further comprising:

a pivotal mount holding said suction plate above said conveying surface; and a suction plate actuating mechanism pivoting said suction plate when suction is applied through said suction plate.

22. The apparatus set forth in claim 21 wherein said suction plate actuating mechanism includes:

a rotary member carrying a shaft engaging a side of said suction plate;

a pneumatic actuator;

an air conduit connecting said rotary member and said pneumatic actuator;

a micro switch communicating with said pneumatic actuator; and a driven timing cam periodically closing said micro switch;

whereby said pneumatic actuator periodically releases air through said air conduit to actuate said suction plate through said rotary member responsive to said closing of said micro switch by said driven timing cam.

23. An apparatus for sequentially opening a plurality of sheets forming a signature, comprising:

a conveying surface;

at least one pivotally mounted suction plate, said suction plate being spaced from said conveying surface and having a working surface facing said conveying surface;

an emergent plate per each pivotally mounted suction plate, said emergent plate being substantially coplanar to said conveying surface; and an advancing mechanism moving said signature along said conveying surface and advancing said signature to a position in proximity to said suction plate.

* * * * *